United States Patent [19]

Free

[11] 4,403,574

[45] Sep. 13, 1983

[54] BOILER PANCAKE DESIGN

[76] Inventor: Stephen Free, 47584 Bursley Rd., Wellington, Ohio 44090

[21] Appl. No.: 272,673

[22] Filed: Jun. 10, 1981

[51] Int. Cl.[3] ..... F22B 5/00

[52] U.S. Cl. ..... 122/353; 122/176; 122/166 R; 122/209 R; 122/16; 122/367 R; 122/235 C

[58] Field of Search ..... 122/16–18, 122/176, 209, 225 R, 232, 225 A, 166 R, 166 A, 378, 229, 371–374, 183–186, 367 R, 367 A, 353, 235 C; 126/99 A, 109, 132

[56] References Cited

U.S. PATENT DOCUMENTS

| | | | |
|---|---|---|---|
| 43,557 | 7/1864 | Flanders | 122/176 |
| 61,210 | 1/1867 | Kilgore | 122/176 |
| 945,130 | 1/1910 | Lycan | 122/176 |
| 1,007,329 | 10/1911 | Briegel | 122/176 |
| 1,008,526 | 11/1911 | Cook | 122/166 |
| 1,024,554 | 4/1912 | Carter | 122/176 |
| 1,031,239 | 7/1912 | Brenner et al. | 122/166 R |
| 1,528,845 | 3/1925 | Patterson | 122/176 |
| 1,794,953 | 3/1931 | Gage | 122/18 |
| 3,572,999 | 3/1971 | Sato | 122/235 C |

FOREIGN PATENT DOCUMENTS

| | | | |
|---|---|---|---|
| 153728 | 11/1920 | United Kingdom | 122/209 R |

*Primary Examiner*—Henry C. Yuen

*Attorney, Agent, or Firm*—Oldham, Oldham, Hudak, Weber & Sand Co.

[57] ABSTRACT

A device constituting an improved boiler design. The heat exchanger, known in the art as a pancake, is composed of an asymmetrical grid of interconnected hollow eliptical conduits through which flow the heat transfer fluid. In one embodiment of the invention, two pancakes are connected in series in such a way that their asymmetry is complementary. Such an arrangement is claimed to increase the efficiency of heat transfer and reduce the frequency of cleaning of the boiler when compared to boilers in the known art.

2 Claims, 6 Drawing Figures

BOILER PANCAKE DESIGN

TECHNICAL FIELD

The invention herein relates to the art of boiler devices. In particular the invention pertains to a boiler which has improvements in design efficiency and a reduced maintenance schedule. The new device is adaptable to a variety of applications from residential to light industrial needs for heat, hot water, and/or steam.

BACKGROUND ART

The small direct-fired boiler, once widely used for domestic heating, has been largely replaced in the home by gas and electric heat. It still finds utility on the farm and in light industrial applications and, because of the recent trend toward energy conservation, may be seeing a resurgence in residential applications.

This type of device is, of course, of ancient origin and thus the prior art is replete with teachings purporting to improve upon the basic design thereof. Some of these inventions are very old. By way of illustration are U.S. Pat. Nos. 404,524; 949,298; 560,848; 1,693,254; 1,512,480; 1,716,508; 1,825,326; and 1,794,953.

None of the foregoing, however, can claim the dramatic improvements in design efficiency of the instant invention. To familiarize the reader with the basic design, terminology, and problems typically encountered in the operation of the boiler, a description of the device would be helpful, to wit: the boiler consists of a firebox, over which is located some sort of heat exchanger which absorbs heat from the fire and transfers it to the fluid inside the exchanger. The fluid is typically water. This heat transfer device has traditionally been known as a "pancake" due to its resemblance to that early morning culinary delight, i.e., it is round and flat. Indeed, the heat exchanger often comprised a plurality of such pancakes or discs stacked atop each other in separated opposed relationship. The fluid is pumped through the exchanger, picking up heat, then circulated to the building or device to be heated and then back to the boiler to be recycled.

A major drawback to known boilers of this general type is that they must be shut down every few days for cleaning. The pancakes accumulate considerable soot and ash over their outer surface and in so doing, decrease considerably the amount of heat that may be transferred to the fluid. In addition, this accumulation may plug up the draft holes located in the pancakes which allow the smoke and fumes from the firebox to pass through to the chimney. The combustion products, having no alternative route, are then forced to eminate out of the firebox proper and into the surrounding environment. This can be most distressing if the boiler is located indoors.

From the foregoing it will be appreciated that a boiler improvement is needed which would eliminate the possibility of plugging, reduce the frequency of cleaning and improve the heat transfer characteristics of the boiler. Such an improvement is the teaching of the instant invention.

DISCLOSURE OF THE INVENTION

It is thus an object of the instant invention to prevent the plugging of the draft holes in boiler pancakes.

An additional object of the invention is to provide a pancake which will reduce the frequency of cleaning by accumulating less ash and soot than has heretofore been known.

It is still a further object of this invention to improve the heat transfer characteristics of the boiler by providing a circuitous route for the hot gases from the firebox.

The foregoing and other objects which will be clarified by reference to the detailed description of the invention are achieved through the use of a boiler comprising:

A firebox, using coal, wood or other suitable fuel; a chimney to allow escape of hot gases; and a series of two or more pancakes stacked horizontally, each of which comprises a symmetrical, interconnected grid pattern of eliptical, hollow conduits.

BRIEF DESCRIPTION OF DRAWINGS

For an understanding in detail of the objects and uses of the invention, reference should be made to the drawings, wherein.

BEST MODE FOR CARRYING OUT THE INVENTION

Figure 1:
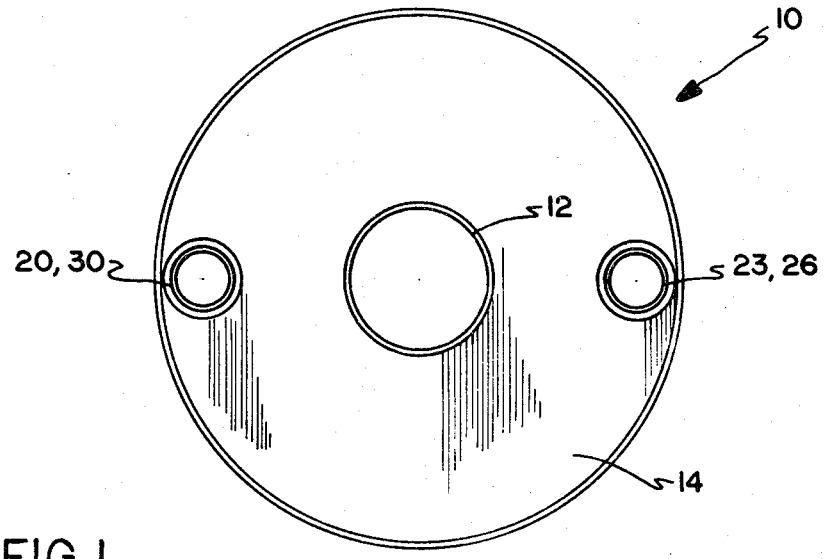
FIG. 1 is a top view of the heat exchanger device known as a pancake, illustrating prior art.
Figure 2:
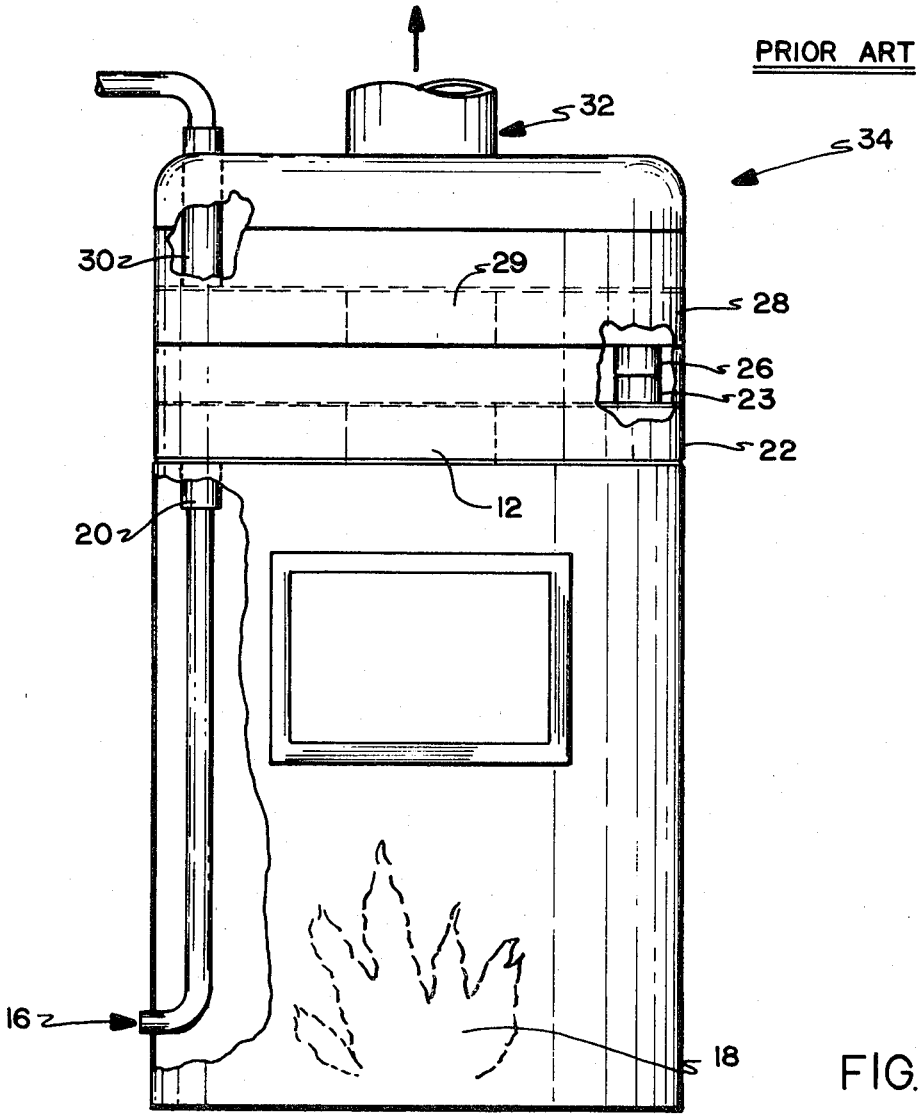
FIG. 2 is a front view of a boiler illustrating placement of the pancakes.

Before proceeding with a detailed description of the invention, reference is made to FIGS. 1 and 2 which are typical illustrations of the known boiler art. FIG. 1 is a pancake designated generally by the number 10. It is appreciated that the large amount of horizontal surface area 14 encourages the accumulation of ash and soot thereon, and thereby allows draft hole 12 to become plugged. The entrance and exit nozzles 20, 23, 26 and 30 convey the heat transfer fluid to successive pancakes and to and from the boiler. Proceeding now to FIG. 2, it is noted that a front view of a typical boiler is designated generally by the number 34. The heat transfer fluid enters the boiler through opening 16 and is conveyed to opening 20 in pancake 22. The pancake 22, heated by hot gases from firebox 18, transfers this heat to the fluid as said fluid passes through the pancake 22 to exit nozzle 23. Hot gases from the firebox 18 pass through draft hole 12. The fluid then enters pancake 28 through entrance nozzle 26 and which comprises a male/female press fit with exit nozzle 23, and is heated further, thereafter exiting through opening 30. The hot gases pass through draft hole 29 to chimney 32.

Figure 3:
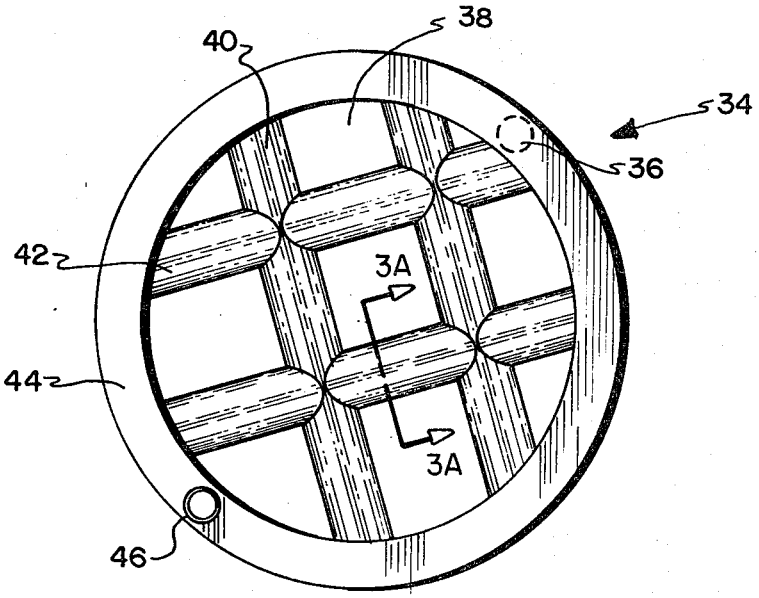
FIG. 3 is a top view illustrating an embodiment of this invention.
Figure 3A:
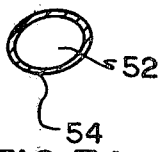
FIG. 3A is a sectional view of a conduit of FIG. 3, taken along the line 3A—3A.
Figure 4:
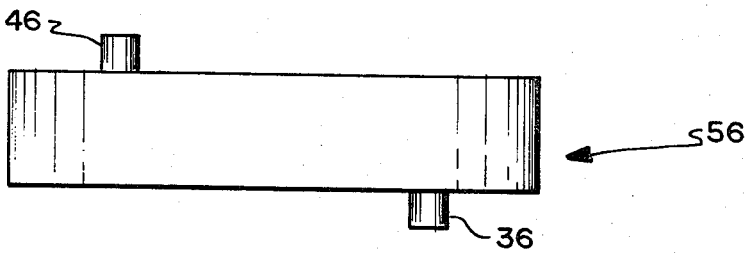
FIG. 4 is an edge view of the pancake.
Figure 5:
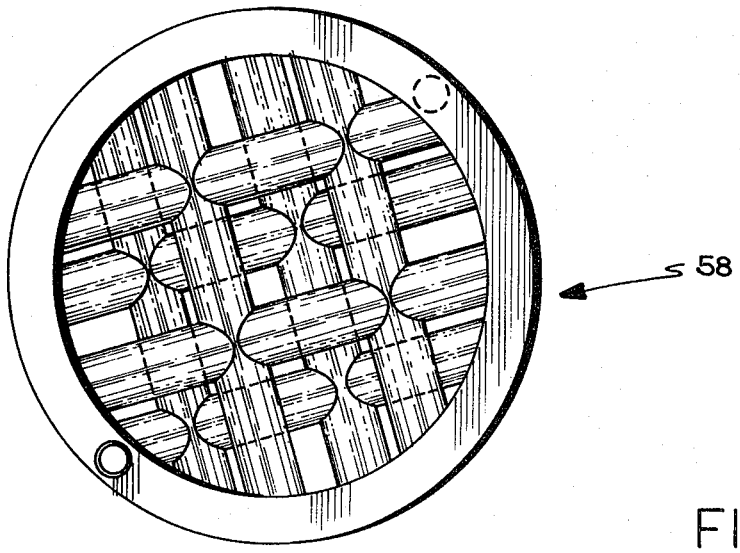
FIG. 5 is a top view of two pancakes in series illustrating an embodiment of this invention.

The embodiment of the instant invention operates in a fashion similar to the above-description except for the configuration of the pancakes. Reference is now made to FIGS. 3, 4, and 5 which illustrate the new pancake design. In FIGS. 3A, 3 is shown a top view of the new pancake designated generally by the number 34. Inlet 36 and outlet 46 are similar to the analogues of FIG. 1. The heat transfer fluid is conveyed in this case not through a flat, horizontal section 14 but through a grid of interconnected, hollow eliptical conduits 40 and 42. As shown in the cross-section of FIG. 3A, the conduits 40,42 are formed by elliptical walls 54 confining an interior passage 52. In place of the drafthole 12 are the grid interstices 38. This novel arrangement does three things viz., (1) due to the eliptical cross-section of the conduits, very little horizontal surface area is available for accumulation of ash and soot. The eliptical is preferred over the circular cross-section because the former has a higher surface to volume ratio. It is noted that a larger percentage of the surface is vertical. This concentration of higher overall surface area and less horizontal area subject to fouling results in greatly enhanced heat transfer. (2) The draft holes or interstices 38 allow ash and soot entrained with the rising hot gases to distribute over a much greater area with the result that the combination at any point is never great enough to plug one of the draft holes 38. (3) It is appreciated that the grid is not symmetrical with respect to the circular support 44. The reason for this is illustrated in FIG. 5 which is a top view of two pancakes connected in series designated generally by the number 58. The pancakes are connected in diametrical fashion, that is, the asymmetry of each grid is rotated 180° relative to the other. The asymmetry provides a circuitous route for the hot gases at the same time it exposes more total heat transfer area to the direct flame in the firebox. The net effect is improvement relative to a symmetrical pattern in both convective heat transfer (due to higher gas velocity) and in radiant heat transfer due to high absorptivity.

From the foregoing description it is observed that the invention satisfies the objects set forth. The invention is applicable in a range of boiler sizes from the smallest residential to light industrial use and can accomodate a range of fluid temperatures. It is noted that the pancake configuration presented hereinabove is not a limitation to two units as more than two may be so stacked in series. It is further noted that, while in accordance with the Patent Statutes, only the best mode and preferred embodiment of the invention has been present and described in detail, it is to be understood that the invention is not limited thereto or thereby. Accordingly, reference should be had to the appended claims.

What is claimed is:

1. A direct fired boiler device comprising:

a firebox in which coal, wood or other suitable fuel is burned to produce combustion products;

a series of two or more heat transfer devices maintained above said firebox, each said heat transfer devices comprising interconnected grid patterns of hollow elliptical-shaped conduits with their respective major axes parallel to the flow path of said combustion produts, said grid pattern being asymmetrical; and a chimney in communication with said firebox to convey said combustion products from the boiler.

2. A boiler, according to claim 1, wherein two or more heat transfer devices of asymmetrical design are stacked in series in such a way that their asymmetry is complementary in whole or in part such that, when taken in immediately adjacent stacked pairs, the resultant grid pattern of the stacked pairs is symmetrical.

* * * * *